US008091991B2

(12) United States Patent
Hanchak et al.

(10) Patent No.: US 8,091,991 B2
(45) Date of Patent: Jan. 10, 2012

(54) CONTINUOUS PRINTHEAD GAS FLOW DUCT INCLUDING DRAIN

(75) Inventors: Michael S. Hanchak, Dayton, OH (US); Kevin P. Egan, Tipp City, OH (US); David J. Nelson, Rochester, NY (US); Joseph E. Yokajty, Webster, NY (US); Randal L. Mullins, Steele, AL (US)

(73) Assignee: Eastman Kodak Company, Rochester, NY (US)

( * ) Notice: Subject to any disclaimer, the term of this patent is extended or adjusted under 35 U.S.C. 154(b) by 837 days.

(21) Appl. No.: 12/127,876

(22) Filed: May 28, 2008

(65) Prior Publication Data

US 2009/0295880 A1 Dec. 3, 2009

(51) Int. Cl.
*B41J 2/09* (2006.01)

(52) U.S. Cl. ..... 347/77

(58) Field of Classification Search ..... 347/77, 347/73–76, 78–82, 90
See application file for complete search history.

(56) References Cited

U.S. PATENT DOCUMENTS 6,899,410 B2 5/2005 Jeanmaire
7,735,980 B2 * 6/2010 Xu et al. ..... 347/77

* cited by examiner

*Primary Examiner* — Kristal Feggins
(74) *Attorney, Agent, or Firm* — William R. Zimmerli

(57) ABSTRACT

In an inkjet printhead using a gas flow, typically air, to deflect select drop into catch, gas flow (air) ducts are employed to direct the air across the drop trajectories. Improved air ducts include liquid flow channels in a wall of the air duct are provided to allow ink to be removed from the air duct without disrupting the air flow in the duct. A process for cleaning the air duct using the liquid flow channel is also provided.

20 Claims, 10 Drawing Sheets

CONTINUOUS PRINTHEAD GAS FLOW DUCT INCLUDING DRAIN

FIELD OF THE INVENTION

This invention relates generally to the field of digitally controlled printing devices, and in particular to continuous ink jet systems in which a liquid stream breaks into droplets that are deflected by a gas flow.

BACKGROUND OF THE INVENTION

Continuous stream ink jet printing uses a pressurized ink source which produces a continuous stream of ink droplets. Stimulation devices, such as heaters positioned around the nozzle, stimulate the stream to break up into drops with either relatively large volumes or relatively small volumes. These drops are then directed by one of several means, including electrostatic deflection or gas flow deflection. Printheads utilizing gas flow for deflection are known and have been described.

In one form of such printheads, the drop deflecting gas flow is produced at least in part by a gas, typically air, drawn into a negative air duct as a result of vacuum applied to the duct. Drops of a predetermined small volume are deflected more than drops of a predetermined large volume. This allows for the small drops to be deflected into an ink capturing mechanism (catcher, interceptor, gutter, etc.) where they are either recycled or discarded. The large drops are allowed to strike the print medium. Alternatively, the small drops may be allowed to strike the print medium while the larger drops are collected in the ink capturing mechanism.

It has been determined that while small drops are deflected by the lateral airflow more than large drops, not all small drops follow the same trajectory. Some of these drops can be deflected sufficiently by the air flow such that they enter the gas flow duct, causing ink puddles to form. Ink puddles in the air duct can also be formed during startup and shutdown of the printhead caused by ink dripping off the upper wall of the gas flow duct and landing on the lower wall of the gas flow duct. Additionally, ink puddles can be formed due to a crooked jet which causes ink to be directed into the gas flow duct. Ink from the puddles of ink in the gas flow duct can be dragged by the gas flow up into the vacuum source that is attached to the gas flow duct, potentially damaging the vacuum source. If the ink puddles remain close to the entrance to the duct, these puddles can affect the uniformity of the air flow across the width of the jet array. Ink puddles can induce oscillations in the gas flow that can produce a modulation in the print drop trajectories that adversely affect print quality.

Accordingly, a need exists to maintain the cleanliness of the gas flow duct and remove ink puddles formed therein.

SUMMARY OF THE INVENTION

According to a feature of the present invention, a continuous printhead drop deflector system includes a gas flow duct including a wall, the wall including a liquid flow channel, the flow channel being in fluid communication with a first port; and a catcher including a channel, the channel being in fluid communication with a second port. The first and second ports are connected to first and second vacuum sources to evacuate fluids from the drop deflector system.

According to another feature of the present invention, a method of cleaning a printhead component includes providing a gas flow duct including a wall, the wall including a liquid flow channel, the flow channel being in fluid communication with a first port; providing a fluid; causing the fluid to flow into the gas flow duct through the liquid flow channel using the first port; and removing at least some of the fluid from the gas flow duct through the liquid flow channel by applying a vacuum to the first port.

According to another feature of the present invention, a method of removing liquid from a continuous printing system component includes providing a gas flow duct including a wall, the wall including a liquid flow channel, the flow channel being in fluid communication with a first port; providing a first vacuum source in fluid communication with the gas flow duct; providing a second vacuum source in fluid communication with the first port; causing any liquid present in the gas flow duct to move to the liquid flow channel by applying a vacuum to the gas flow duct using the first vacuum source; and removing the liquid from the liquid flow channel by applying a vacuum to the first port using the second vacuum source.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
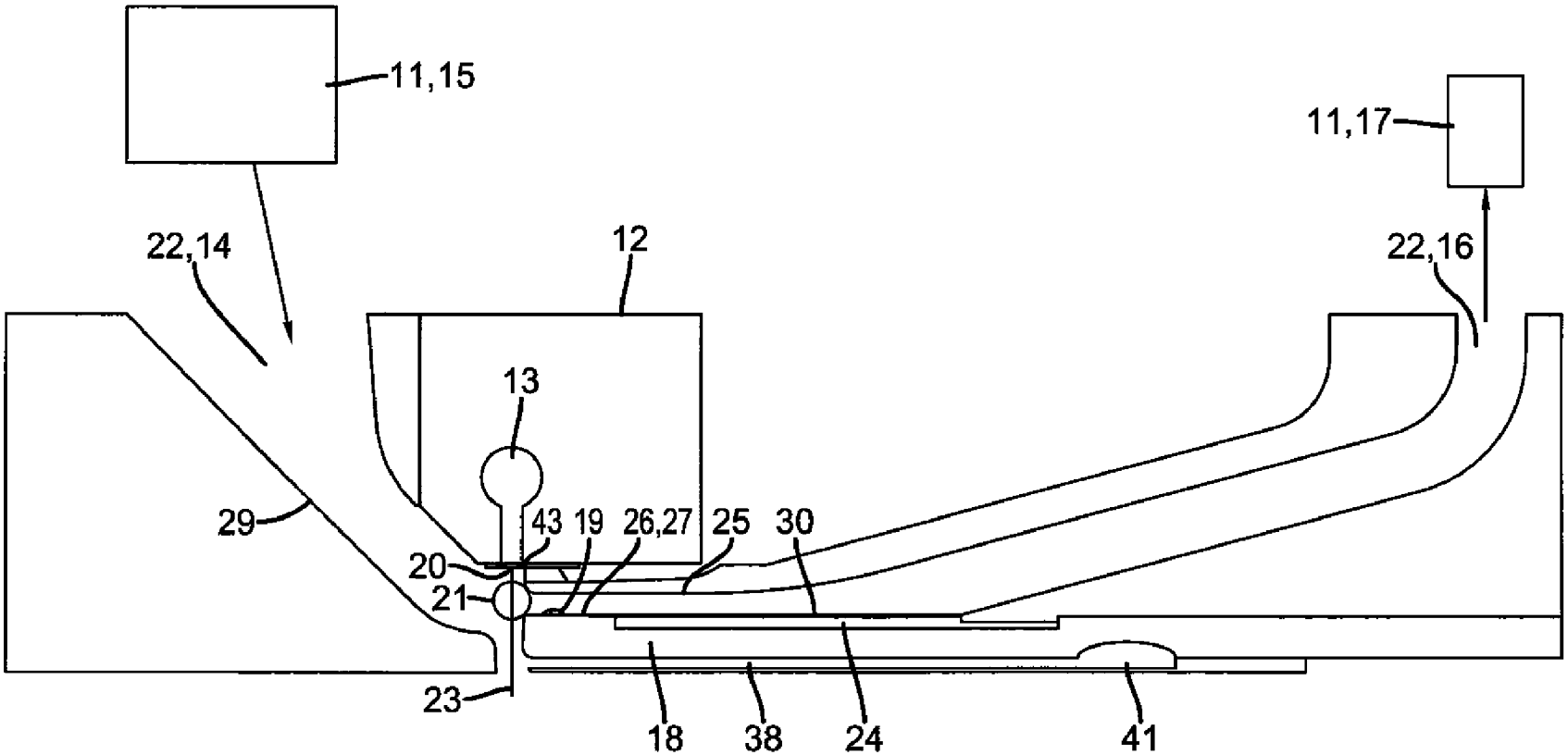
FIG. 1 is a schematic illustration of an example embodiment of a continuous ink jet printhead of the present invention.

FIG. 1 shows a gas flow drop deflection continuous inkjet printhead. Ink is supplied under pressure by a fluid system (shown in FIG. 7) to a jetting module 12. An ink supply channel 13 in the jetting module 12 provides ink to a plurality of nozzles 20. A stimulation device, for example a heater 43, associated with each nozzle 20, is employed to selectively create large and small drops that follow and initial drop trajectory 23. A drop deflection system includes one or more gas flow ducts 22, each gas flow duct 22 having an associated gas flow source 11. Gas flow duct 22 is a positive gas flow duct 14. When the gas flow source 11 is in the form of a fan or blower 15 that directs a flow of gas into the gas flow duct and produces a positive pressure gas flow in the gas flow duct that is directed across the drop trajectories. Gas flow duct 22 is a negative gas flow duct 16. When the gas flow source 11 is in the form of a vacuum source 17 that draws gas from the gas flow duct and produces a vacuum or negative pressure in the gas flow duct. The gas being drawn into the negative gas flow duct by the negative pressure produces a flow of gas across the drop trajectories 23. The flow of gas across the drop trajectories 23, produced by a positive, a negative, or by both positive and negative gas flow ducts causes the drops to be deflected from their initial trajectories. The space around the drop trajectories 23 from the plurality of nozzles in which the flow of gas across the drop trajectories 23 produces the deflection of the drops is called the drop deflection zone 21. Gas flow ducts 22 in the region, adjacent to the drop deflection zone 21, have a width (in and out of FIG. 1) that is greater than the length of the nozzle array (also in and out of FIG. 1).

The gas flow ducts 22 are bounded by walls. FIG. 1 shows an upper wall 25 and a lower wall 27 of the negative gas flow duct 16 and the lower wall 29 of the positive gas flow duct 14. In this embodiment, wall 26 is also lower wall 27 of the negative gas flow duct 16, though wall 26 can be any of the walls of the gas flow ducts 22. A portion of the jetting module 12 forms part of the upper wall of the positive gas flow duct 14.

Figure 7:
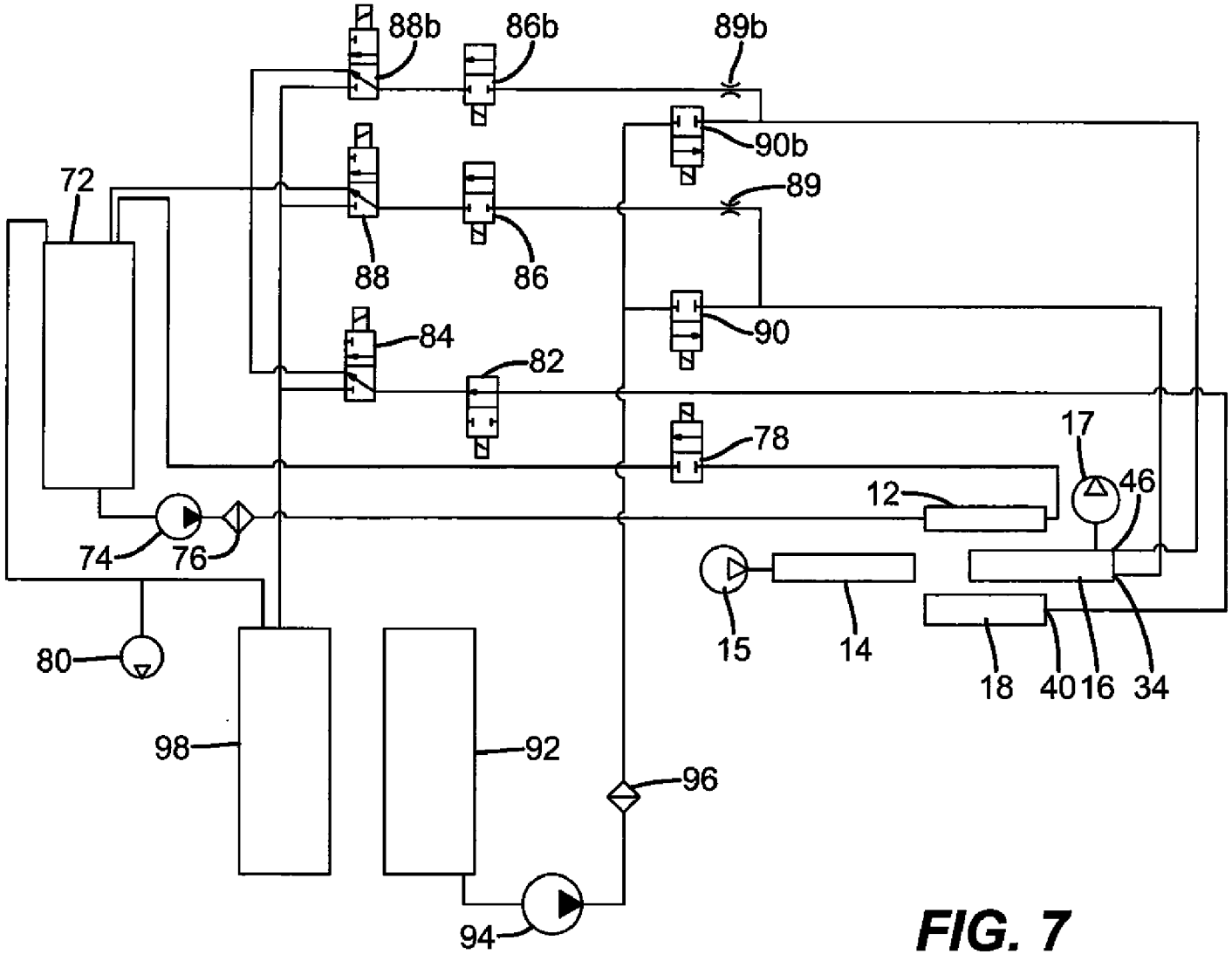
FIG. 7 is a schematic diagram of an example fluid system of the present invention.

A catcher 18 is used to intercept the trajectories of the small drops, and while allowing the large drops to strike the print media. The catcher 18 includes catcher flow channel 38 which is in fluid communication with a catcher (second) port 40 shown in FIG. 2. Second port 40 is in fluid communication with a vacuum source for removal of ink from the catcher 18. The vacuum source can be included as part of a fluid system of the inkjet printing station (shown in FIG. 7), allowing the ink to be recycled or sent to a waste tank. The fluid system can also include a valve to control the flow of recovered ink to the ink reservoir or waste tank. An exemplary fluid system is illustrated in FIG. 7 and is described later. In this example embodiment, the vacuum source in fluid communication with catcher (second) port 40 is distant from vacuum source 17 which is associated with negative gas flow duct 16.

Figure 4:
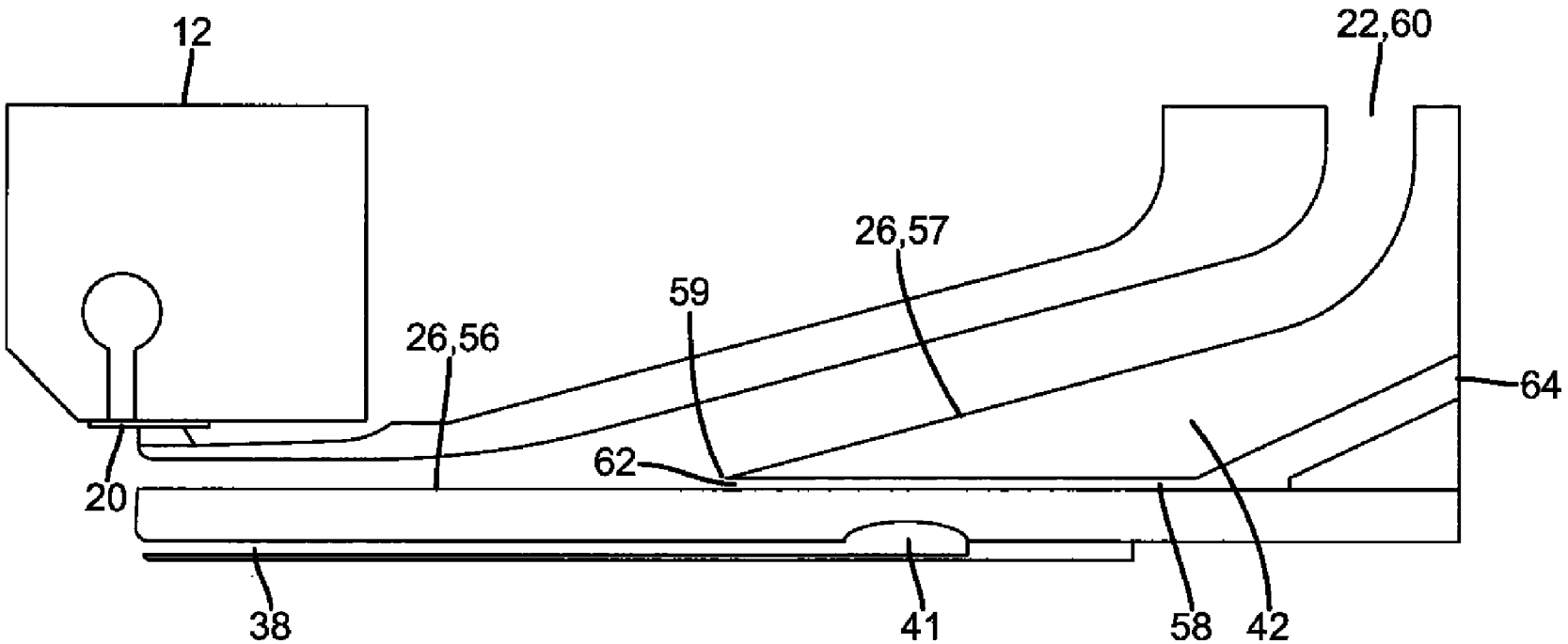
FIG. 4 is a schematic illustration of another example embodiment of the present invention.
Figure 5:
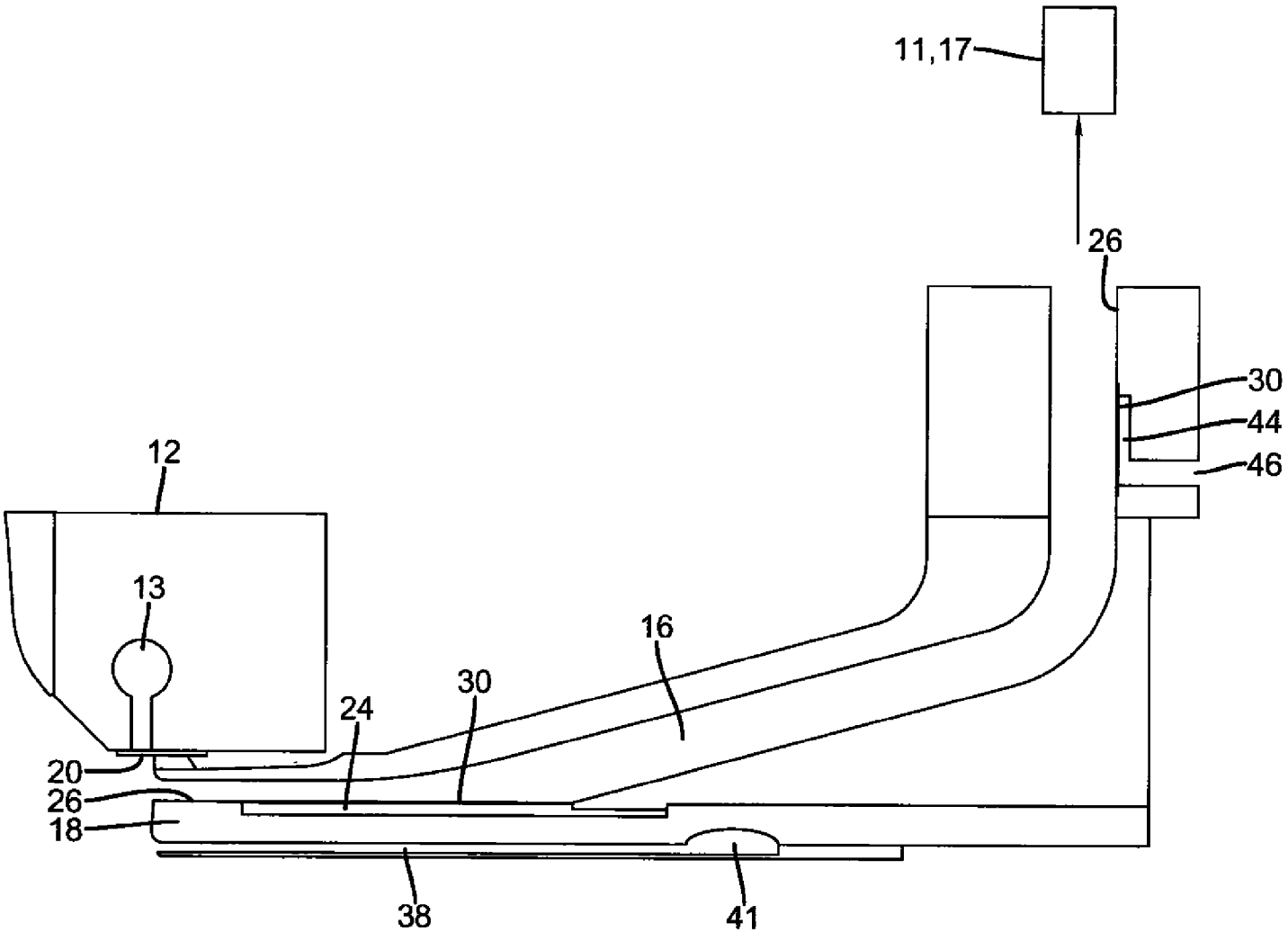
FIG. 5 is a schematic illustration of another example embodiment of the present invention.

To remove ink or other debris from the gas flow duct 22, liquid flow channel 24 is formed in a wall 26 of the gas flow duct 22. In some embodiments, such as is shown in FIGS. 1, 4, and 5, the wall 26 in which the liquid flow channel 24 is formed in lower wall 27 of the gas flow duct 22. Flow channel 24 can be located proximate drop deflection zone 21, as is shown in FIG. 1. Alternatively, flow channel 24 can be located farther from the drop deflection zone 21, as is shown in FIG. 4. Typically, the location of flow channel 24 relative to drop deflection zone 21 depends on where gas flow duct 22 collects liquid puddles and debris.

Figure 2:
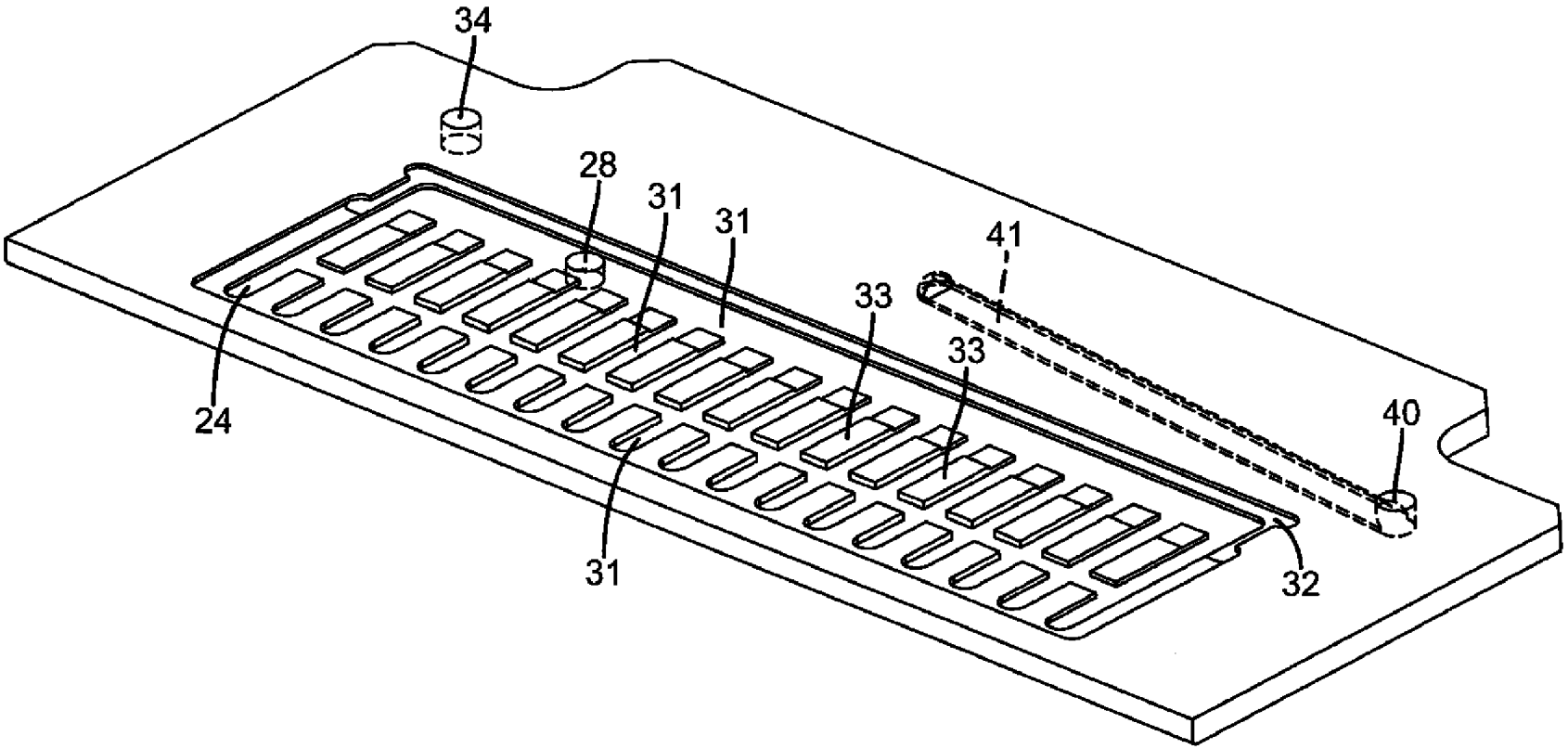
FIG. 2 is a schematic illustration of the wall of the gas flow duct of the present invention.
Figure 3:
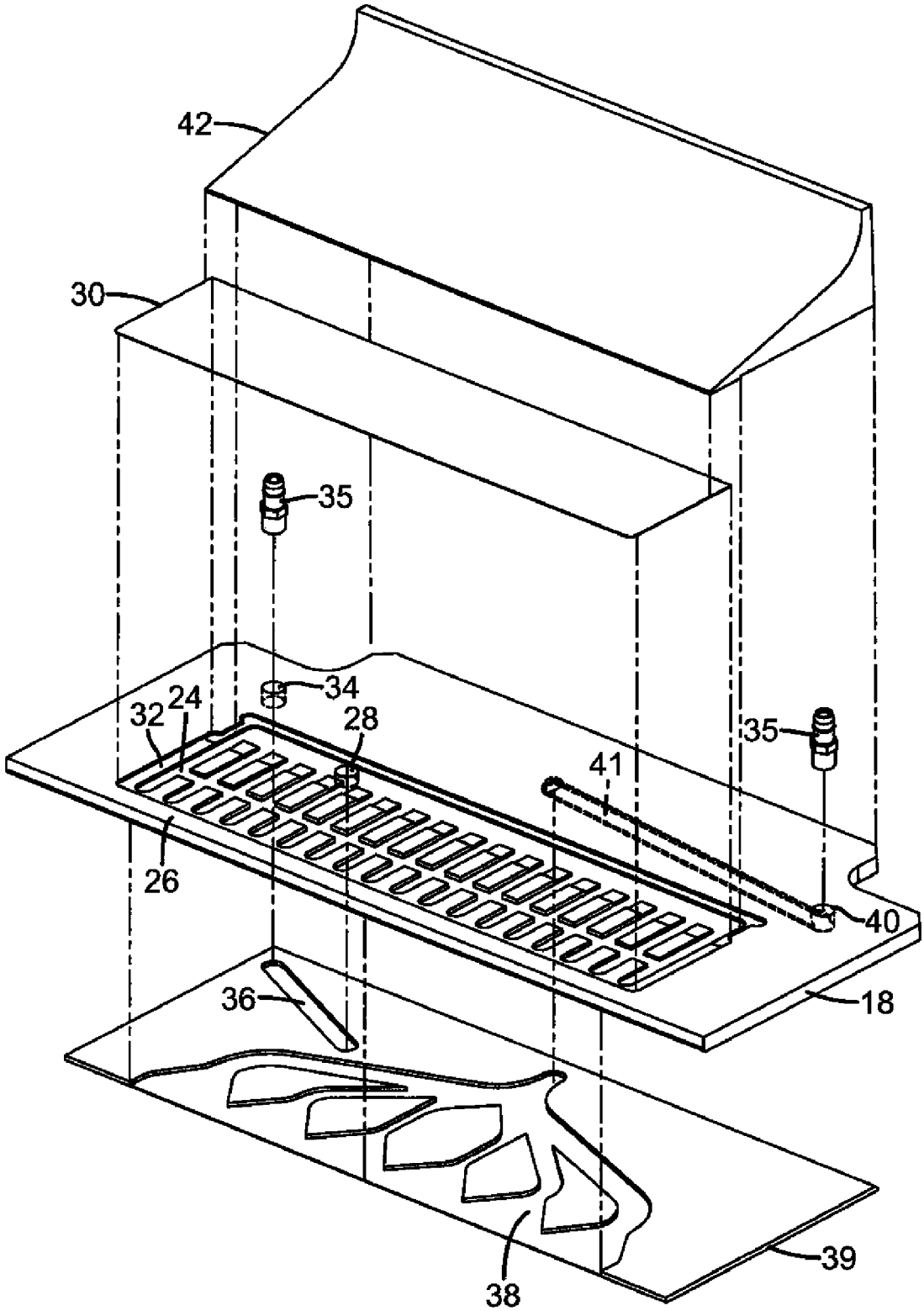
FIG. 3 is an exploded view of an example embodiment of the present invention.

The liquid flow channel 24 is shown from another perspective in FIGS. 2 and 3. Liquid flow channel 24 is in fluid communication with a liquid flow channel port 34 (a first port). Liquid flow channel port (first port) 34 is in fluid communication with a vacuum source (shown in FIG. 7) for removal of liquid from the liquid flow channel 24. The fluid communication can be provided through tubing that can be attached to fitting 35 that is attached to the first port 34. The vacuum source can be included as part of a fluid system of the inkjet printing station, allowing the liquid removed through the first port 34 to be recycled or sent to a waste tank. Liquid flow channel 24 and port 34 are isolated from catcher flow channel 38 and port 40 which helps to better control liquid flow, gas flow, and/or vacuum levels in liquid flow channel 24 and catcher flow channel 38.

The vacuum source in fluid communication with liquid flow channel port 34 (first port) is a separate vacuum source than the vacuum source 17 associated with negative gas flow duct 16. Additionally, the vacuum source in fluid communication with first port 34 can be separate from the vacuum source in fluid communication with second port 40. Alternatively, the first and second ports 34 and 40 can use the same vacuum source (shown in FIG. 7). If a common vacuum source is in fluid communication with the first and second ports, valves can be used in the fluid conduit between the ports and the vacuum source to enable the two ports to be used independently of each other.

Referring to FIG. 2, the liquid flow channel 24 is in fluid communication with the first port 34 through a gas flow duct drain 28. Islands 33 are formed in the liquid flow channel 24, creating flow channel segments 31 between the islands 33. This creates a desired flow channel geometry, such as a branching flow channel geometry which balances pressure drops in each branch of the structure and avoids turbulence-producing flow junctions and turns. The liquid flow channel segments 31 vary in cross section to improve the ability to evacuate ink from all portions of the fluid channel. Preferably, segments 31 of the liquid flow channel 24 through which liquid flows in greater volume or for longer distances will have greater cross sectional area than segments 31 through which liquid having lesser volumes and distances flows. In some embodiments, the liquid flow channel 24 can be angled downward toward the drain 28 to facilitate movement of the fluid toward the drain 28.

Referring to FIG. 3, drain 28 is in fluid communication with first port 34 via a drain channel 36. In a preferred embodiment, the catcher 18 includes a wall that forms the wall 26 of the gas flow duct 22. When this arrangement is used, the drain channel 36 can be formed in a surface of the catcher 18 or the catcher plate 39.

As capillary forces will tend to trap liquid in inside corners, it is desirable to have the liquid flow channel 24 span substantially the whole width of the gas flow duct 22 (in and out of FIG. 1). Similarly, if the gas flow duct contains any ribs or flow controlling blades that span from the upper to the lower wall of the gas flow duct, it is desirable to have a segment of the liquid flow channel positioned directly under at least a portion of the rib or flow controlling blade so that liquid isn't trapped at the corner between the rib and the wall of the gas flow duct.

Referring to FIG. 3 and back to FIG. 1, a porous member 30 is positioned to cover the liquid flow channel 24. The porous member 30 prevents the liquid flow channel 24 and liquid moving through the liquid flow channel 24 from disrupting the flow of gas through gas flow duct 22 while allowing the ink to enter the liquid flow channel 24. Preferably, porous member 30 is a screen formed from a hydrophilic material or a material with a hydrophilic coating. More preferably, porous member 30 is a screen formed from a micro-perforated metal or a woven wire mesh. Additionally, it is preferable that wall 26 include a recess 32. Recess 32 allows the porous member 30 lie substantially flush with wall 26, providing a substantially level plane to further minimize any disruption to the gas flow through the gas flow duct 22. The porous member 30 is bonded to islands 33 which are formed in the liquid flow channel 24 and to the recess 32. In embodiments lacking either one or both of the recess 32 and islands 33, the porous member 30 can be bonded directly to the wall 26. When porous member 30 covers liquid flow channel 24 which is located in lower wall 27 of the negative duct drain, a ramping duct wall transition piece 42 can be provided to facilitate in the directing of gas flow through the gas flow duct 22, thereby minimizing disruption to the gas flow and enhancing the print quality. The ramping duct wall transition piece 42 is secured to wall 26 and covers at least a portion of the liquid flow channel 24. Ramping duct wall transition piece 42 helps to ease the flow from a substantially horizontal gas flow path to a substantially vertical gas flow path by providing a gradual bend. This gradual bend created by the transition from a first portion to second portion in gas flow duct 22 allows space to be minimized while maintaining a substantially laminar flow.

In an alternate embodiment shown in FIG. 4, a wall 26 of the gas flow duct 22 includes a first portion 56, a second portion 57, and a transition 59 between the first portion and the second portion. The second portion 57 of wall 26 is non-parallel relative to the first portion 56 of wall 26. The transition 59 between the first portion 56 and the second portion 57 of wall 26 can include a gentle curve, an angled ramp (as shown in FIG. 4), a sharp change in direction, or any other transition desired. A liquid flow channel 58 can be fabricated in the wall 26 at the seam between the first portion 56 and the second portion 57 of the wall 26 when the gas flow duct 22 is formed by joining two or more pieces of material together, as is the gas flow duct 22 in FIG. 4. Alternatively, liquid flow channel 58 can be integrally formed in the wall 26 of the gas flow duct 22, such as by boring or molding when the gas flow duct 22 is formed of one piece of material.

The liquid flow channel 58 has liquid channel inlet 62 in the form of a hole or passage way at the transition 59 between the first portion 56 and the second portion 57 of the wall 26. Preferably, the liquid channel inlet 62 comprises a plurality of holes or passage ways positioned parallel to nozzles 20 to facilitate the entry of ink and debris into the liquid flow channel 58. With the liquid channel inlets 62 placed at the transition 59 between the first portion 56 and the second portion 57, ink moving along the first portion 56 readily enters the liquid channel inlets 62. This placement also produces minimal disruption of the gas flow in the gas flow duct 22. Liquid flow channel 58 is in fluid communication with a first port 64. First port 64 is in fluid communication with a vacuum source, as described in the previous embodiment.

Referring now to FIG. 5, an alternative embodiment of the invention includes a second liquid flow channel 44 that is formed in wall 26 of the gas flow duct 22. The gas flow duct on the opposite side of the jet array has been omitted in this Figure. This second liquid flow channel 44 is located between the first liquid flow channel 24 and the gas flow source 11. As with the first liquid flow channel 24, it is preferable that the second liquid flow channel 44 cover substantially the whole width (in and out of FIG. 5) of the gas flow duct 22 and extend all the way to the side walls of the gas flow duct 22. The second liquid flow channel 44 is in fluid communication with a third port 46. Third port 46 is in fluid communication with a vacuum source. This vacuum source can be the same vacuum source which is in fluid communication with first port 34 or, alternatively, it can be an additional vacuum source.

Referring back to FIG. 3, to evacuate ink and debris from gas flow duct 22, a vacuum source (shown in FIG. 7) is applied to first port 34. As a result, ink and debris that has landed on porous member 30 is drawn through a pore, flows through the liquid flow channel 24, the duct drain 28, the drain channel 36, out through the first port 34, and is returned to the ink reservoir for reuse. Alternatively, the ink and debris can be directed to a waste tank, allowing any contaminants to be removed from the system. Additionally, the gas flow source 11 associated with gas flow duct 22 can be turned on at a low level to cause ink puddles and debris not in contact with a pore of porous member 30 to move into contact with a pore of porous member 30, allowing them to be drawn into the liquid flow channel 24.

Not only can the liquid flow channel be used to remove ink from the gas flow duct, but it also can be clean the portions of the gas flow duct as well. To facilitate the cleaning of the gas flow duct, first port 34 is isolated from the vacuum source and is put in fluid communication with a supply of a cleaning or maintenance fluid. Such an arrangement allows the cleaning or maintenance fluid to be introduced to the gas flow duct through first port 34 and fluid channels 24.

Figure 6A:
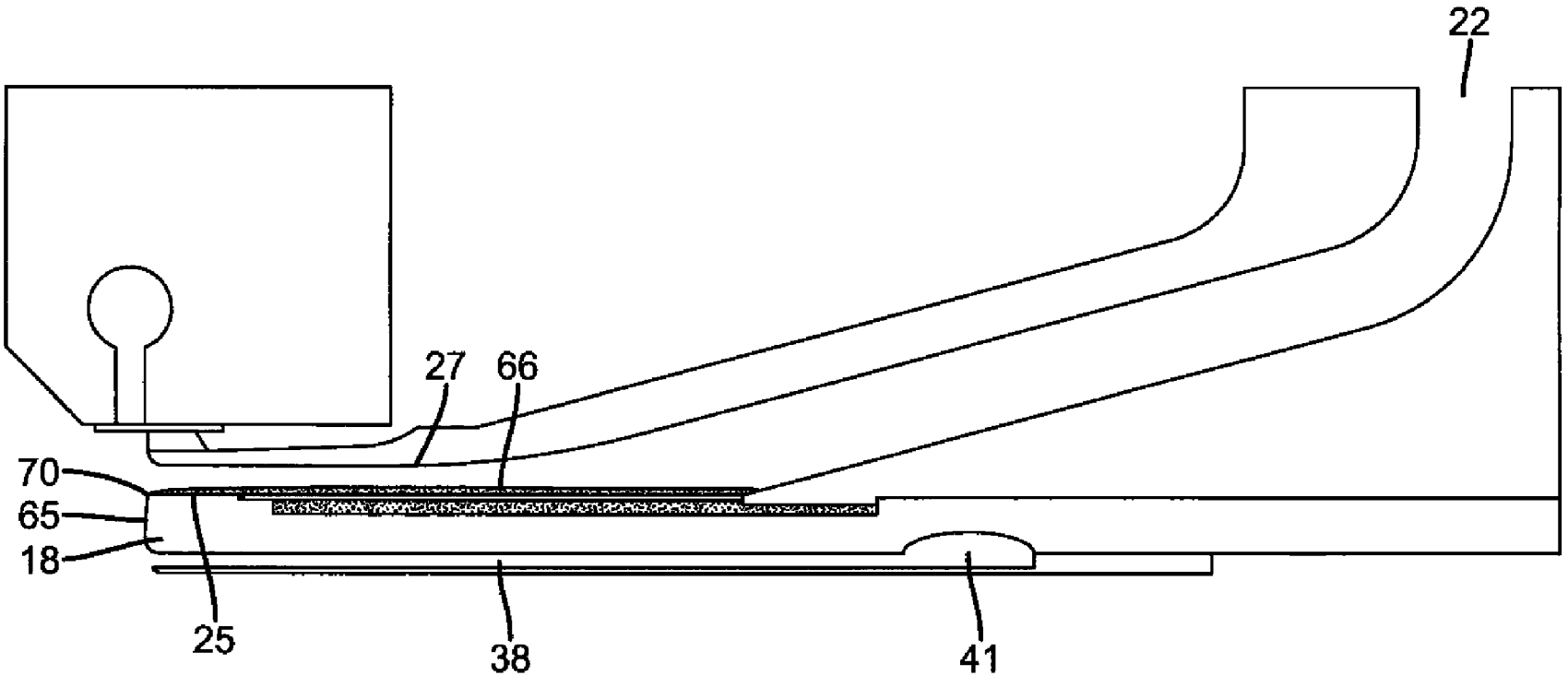
FIGS. 6*a* and 6*b* are schematic illustrations of an example cleaning operation of the present invention.

Referring now to FIG. 6*a*, the fluid flows through the first port 34, through the duct drain channel 36, through the drain 28, and into liquid flow channel 24. The fluid first fills liquid flow channel 24 before beginning to pass through porous member 30. As the fluid passes through porous member 30, it flows across wall 26 and begins to fill the gas flow duct 22. Surface tension serves to inhibit the flow of the cleaning fluid 66 over the sharp corner at the edge 70 between the wall 26 of the gas flow duct 22 and the catcher face 65. This helps the fluid to bridge the gap between the upper wall 27 of the negative gas flow duct, allowing it to contact this surface as well as the surface of the lower wall 25. When a cleaning fluid is used, this contact with the upper wall of the gas flow duct can serve to clean the upper wall of any ink or debris.

Figure 6B:
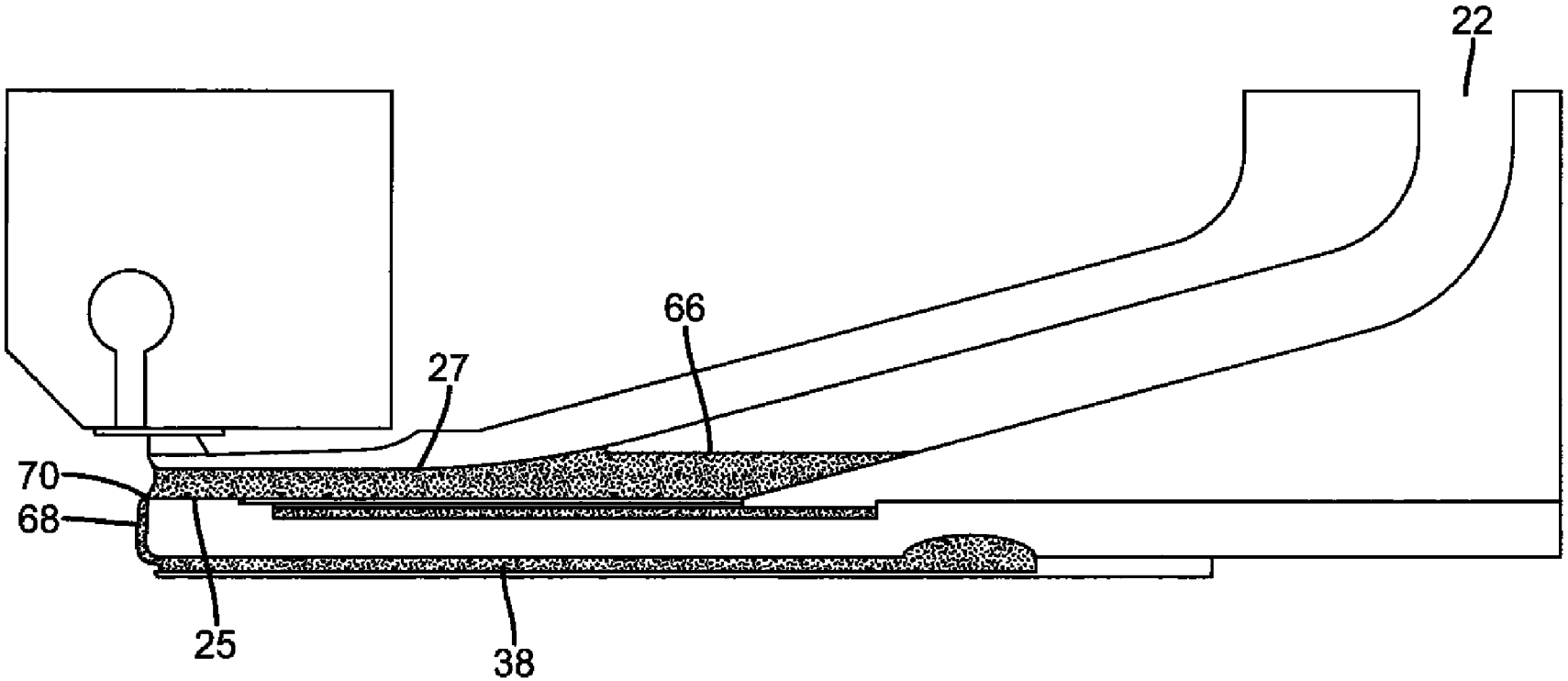

In some embodiments, fluid is introduced to the gas flow duct 22 until it begins to flow over the edge 70 between the lower wall 25 of the gas flow duct and the catcher face and onto the catcher face 65. Optionally, a seal, commonly called an eyelid, can be brought into contact with the catcher plate 39 to prevent any fluid from leaking out of the printhead and onto the print media. A flow of cleaning fluid 68 proceeds down the catcher face 65 and enters the catcher flow channel 38, as shown in FIG. 6*b*. A second vacuum source connected to second port 40 is employed to evacuate this fluid from the catcher flow channels via transfer channel 41. This embodiment serves to clean the not only the gas flow duct 22 but also the catcher face 65 and the catcher flow channels 38, along with the catcher return line and valves. During the cleaning cycle, catcher port 40 (second port) is in fluid communication with a waste tank through the catcher return line. This ensures that only minimal amounts of fluid enter the ink reservoir.

FIG. 7 shows an exemplary fluid system that can be employed with this invention to drain fluid from the gas flow duct and also for the process of cleaning the gas flow duct. Fluid system 71 has an ink reservoir 72 from which ink is pumped to the jetting module 12 through filter 76 by ink pump 74. To aid in flushing contaminates from the jetting module 72, ink can be cross flushed through the jetting module and returned to the ink reservoir when the cross flush valve 78 is open. A vacuum on the ink reservoir provided by vacuum pump 80 aids in returning the ink to the ink reservoir 72. Ink jetted from the jetting module 12 that is collected by catcher 18 is removed from the catcher through catcher port 40 (second port) through an open catcher valve 82 and is returned to the ink reservoir 72 via catcher waste valve 84. The vacuum on the ink reservoir 72 aids in the return of this ink as well. The ink drops produced by the jetting module are deflected by the lateral flow of gas across the drop trajectories produced by gas source 15 directing gas through the positive gas flow duct 14 toward the drop trajectories and by suction into the negative air duct 16 provided by the vacuum source 17. Ink entering the negative air duct can be removed from the duct through the first port 34. This ink is removed from the first port 34 through open valve 86 and is directed to the ink reservoir 72 through return select valve 88 as a result of vacuum on the ink reservoir provided by vacuum pump 80. Pump 94 is turned off and liquid supply valve 90 is closed during this process. A flow restrictor 89 may be used in the fluid line from the first port to limit the amount of air drawing into the liquid flow channel. If a second liquid flow channel 44 is employed to remove liquid from the gas flow duct, the flow through that liquid flow channel 44 and third port 46 passes through open valve 86*b* and is directed to the ink reservoir 72 by return select valve 82*b*. This flow may be limited by flow restrictor 89*b*. A system of valves is employed to allow first port 34 to be in fluid communication with fluid reservoir and to block communication with the ink reservoir or to allow first port 34 to be in fluid communication with the ink reservoir and to block communication with the fluid reservoir. This prevents the ink from the ink reservoir from mixing with the fluid from the fluid reservoir and contamination.

Once ink and debris present in the gas flow duct 22 has been evacuated, further cleaning can be accomplished by using the valves to shut off fluid communication between first port 34 and the ink reservoir 72 and to allow first port 34 to be in fluid communication with a fluid reservoir containing the fluid. To clean the gas flow duct 16, valve 86 is closed and valve 90 is opened. Pump 94 is energized to supply cleaner liquid from the cleaner liquid reservoir 92 through filter 96 to the first port 34. The cleaner fluid can then enter the gas flow duct through the liquid flow channel as discussed previously. The flow of cleaner liquid can be stopped by turning off the pump 94 and closing the valve 90. Additionally, gas flow source 11 can be activated at a low level sufficient to cause a flow of gas through the gas flow duct 22 to interact with the fluid during the soak time. The gas flow can be selected so as to prevent the fluid from leaking out of the gas flow duct 22, to bubble or be agitated, or to be moved through the gas flow duct 22. In embodiments where increased protection of gas flow source 11 is desired, a second flow channel can be located in the gas flow duct 22 between the first flow channel and the gas flow source 11 (as shown in FIG. 5). Such an arrangement provides for an additional exit pathway for any fluid that is drawn up into the gas flow duct 22. The used cleaner fluid can then be drained from the gas flow duct, after an appropriate soak time if desired, through the first port 34. This is achieved by opening valve 86. Return select valve 88 is used to direct the used cleaner liquid to waste tank 98. Vacuum on the waste tank 98 produced by vacuum pump 80 serves as the vacuum source to remove the spent cleaner liquid from the negative gas flow duct 16.

If desired, as described earlier, sufficient cleaner fluid can be supplied to the gas flow duct to produce a flow down the catcher face and into the catcher flow channels. This spent cleaner liquid can be removed from the catcher through the second port 40. This liquid flows from the second port 40 through an open catcher valve 82 and is directed to the waste tank 98 by catcher waste valve 84 as a result of the vacuum on the waste tank 98 provided by vacuum pump 80.

As discussed earlier and shown in FIG. 5, embodiments of the invention can include a second a second liquid flow channel for removal of liquid from the gas flow duct through a third port. Such an embodiment allows the first liquid flow channel to be used to clean a first portion of the gas flow duct and the second liquid flow channel to be used to clean a second portion of the gas flow duct. For example, the first liquid flow channel can be used to clean the lower portion of the gas flow duct as has been described previously. Then cleaning liquid can be supplied to the second liquid flow channel 44 by means of pump 94 through liquid flow valve 90*b*. (Liquid supply valve 90 should be closed during this time.) The cleaning fluid can flow down the gas flow duct wall and can be removed from the gas flow duct by through the first liquid flow channel 24 and the first port 34. By allowing the cleaning fluid to flow to third port 46, sections farther up the gas flow duct 22 can be cleaned, allowing build up and debris in these sections to be removed.

Figure 8:
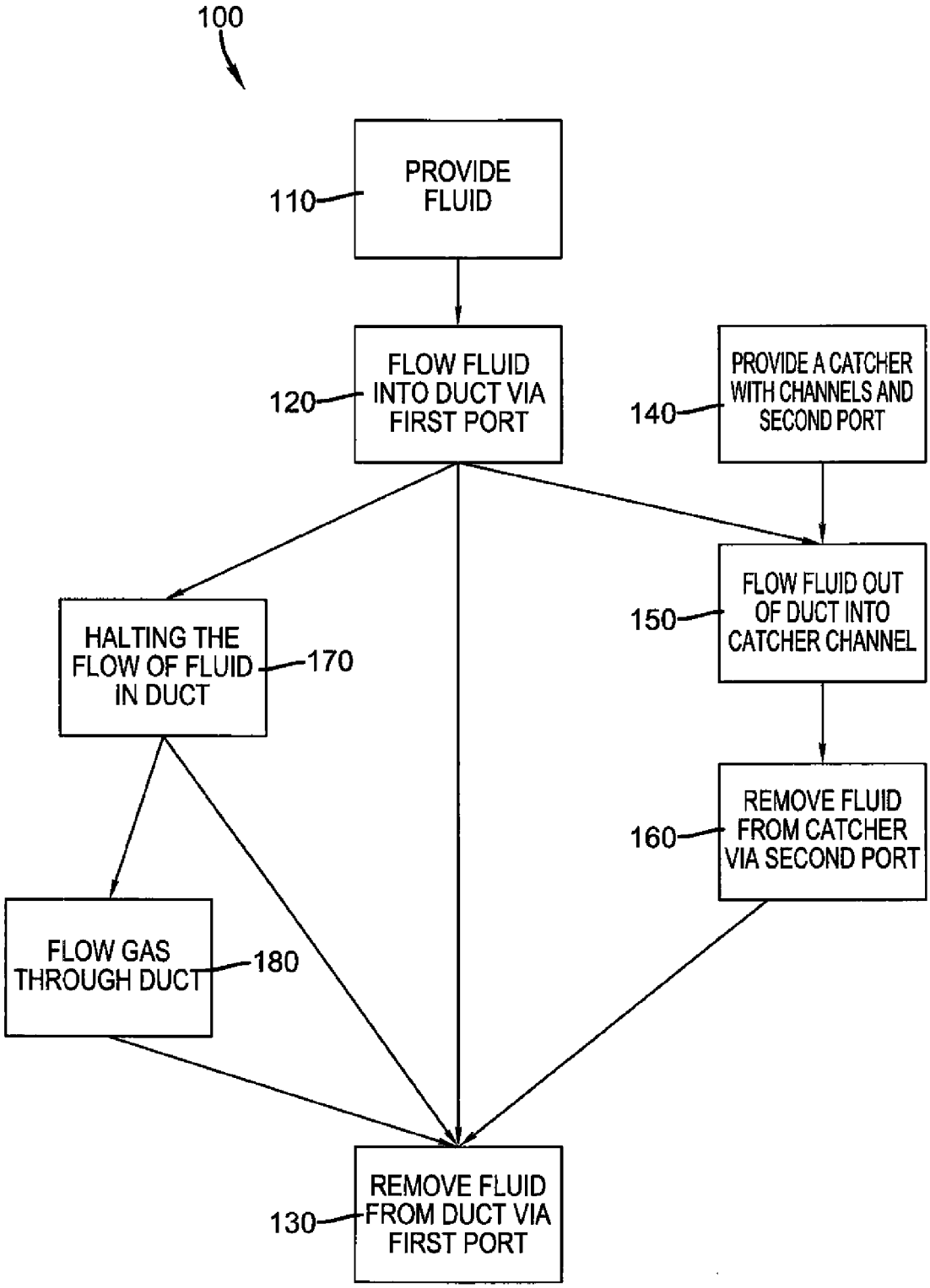
FIG. 8 shows a flow diagram of a method of cleaning a printhead component of the present invention.

FIG. 8 provides a flow diagram showing one embodiment of a method for cleaning a printhead such as is shown in FIG. 1. As is shown in FIG. 7, a fluid is provided from a cleaner liquid reservoir 92 (Step 110) and is pumped by pump 94 through the fluid system to first port 34. The fluid flows from first port 34 through the drain, the liquid flow channel 24, the porous member 30, and into the gas flow duct 22 (Step 120) as is shown in FIG. 6*a*. In embodiments which include a catcher 18 with catcher flow channel 38, and second port 41 (Step 140), fluid can continue to be flowed into gas flow duct 22 until it flows over the edge 70 of catcher face 65, down catcher face 65, and into catcher flow channel 38 (Step 150), as shown in FIG. 6*b*. In such embodiments, an eyelid can optionally be used as a seal against the catcher plate to prevent any fluid from leaking out of the printhead. When fluid is flowed into catcher flow channel 38, the fluid in the catcher flow channel 38 is removed from the catcher flow channel 38 by providing a vacuum source to second port 41 (Step 160). Fluid present in the gas flow duct 22 is removed through the liquid flow channel 24 by applying a vacuum source to first port 34 (Step 130).

Other embodiments of a method for cleaning a printhead include optionally stopping the flow of fluid once it has entered the gas flow duct 22 (Step 170). This permits the fluid time to dissolve dried ink while minimizing the quantity of fluid used. In some embodiments, the gas flow source 11 can be activated to cause a flow of gas to flow through the gas flow duct 22 and interact with the fluid (Step 180). The gas flow can be adjusted to keep the fluid from leaking out of the gas flow duct 22, to bubble or agitate the fluid for enhanced cleaning, or even to move the fluid through the gas flow duct 22. After an appropriate amount of time has passed, the flow of fluid is restarted. When the appropriate amount of fluid has been introduced to the system, the flow of fluid is stopped. Once the flow of fluid has been stopped, the valves associated with first port 34 are adjusted to establish fluid communication between first port 34 and the waste tank and to close fluid communication between first port 34 and the fluid reservoir. Regardless of whether the flow of fluid has been paused in the duct or not, at least some of the fluid from the gas flow duct 22 is removed through the liquid flow channel 24 by applying a first vacuum source to first port 34 (Step 130).

Figure 9:
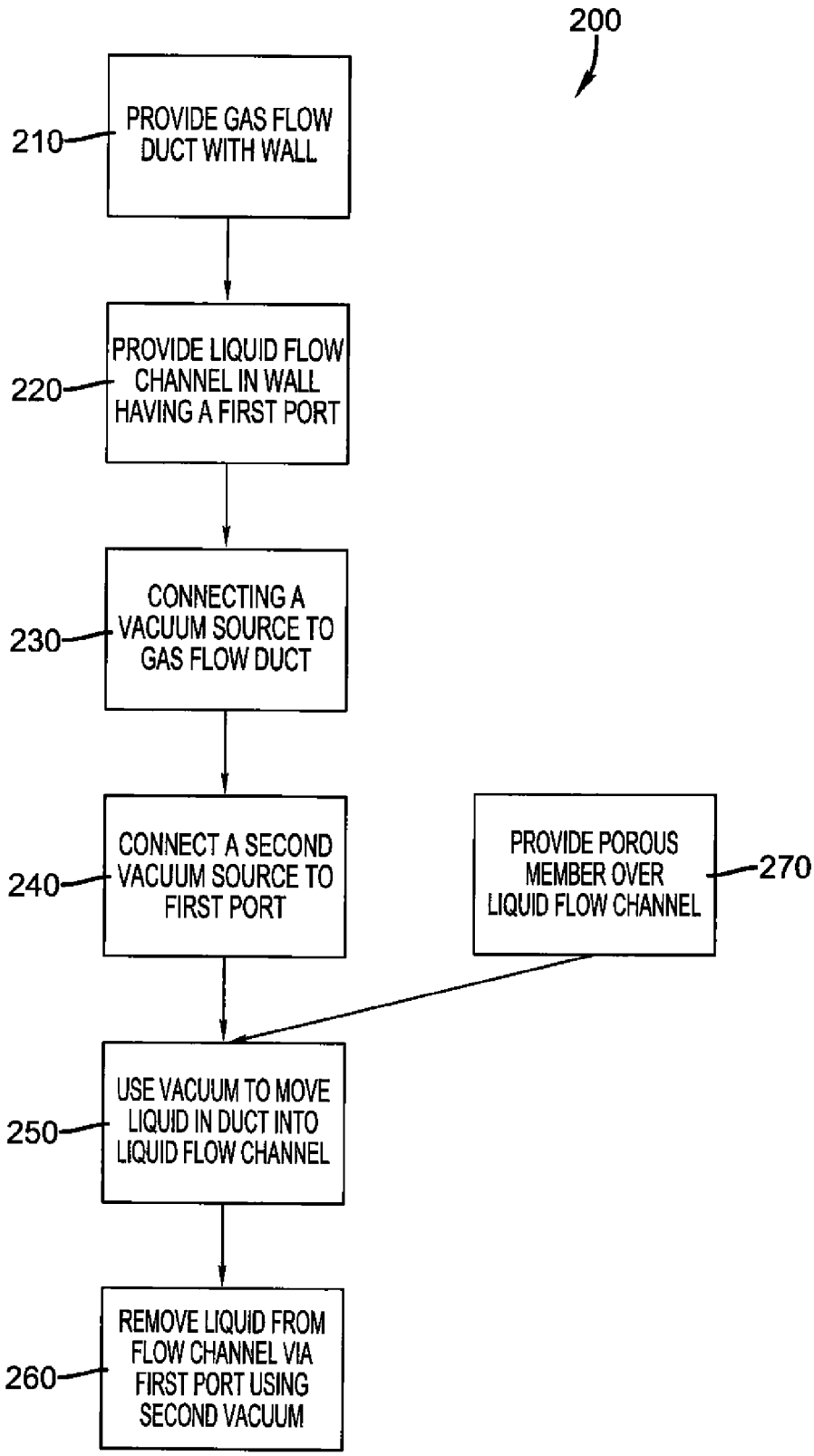
FIG. 9 shows a flow diagram of a method of removing a liquid from a printhead component of the present invention.

FIG. 9 provides a flow diagram showing one embodiment of a method for removing fluid from a printhead such as is shown in FIG. 1. Gas flow duct 22 is connected to a first vacuum source 17 (Step 230), making gas flow duct 22 a negative gas flow duct 16. A second vacuum source 80 is connected to first port 34 (Step 240). The vacuum is tuned on, causing liquid and debris present in the negative gas flow duct 16 to migrate into the liquid flow channel 24 present in wall 26 of the duct (Step 250). Where there is a porous member located over the liquid flow channel (Step 270), the liquid and debris passes through the pore to enter the liquid flow channel (Step 270). Vacuum 80 pulls the liquid through and out of the flow channel 24 and drain 28 through first port 34 (Step 260). The fluid is then pulled through the fluid system, as shown in FIG. 7, to the waste tank 98.

The invention has been described in detail with particular reference to certain preferred embodiments thereof, but it will be understood that variations and modifications can be effected within the scope of the invention.

PARTS LIST

10 Drop deflector mechanism
11 Gas flow source
12 Jetting module
13 Ink supply channel
14 Positive gas flow duct

15 Blower
16 Negative gas flow duct
17 Vacuum source
18 Catcher
19 Ink puddle
20 Nozzle
21 Drop deflection zone
22 Gas flow duct
23 Drop trajectories
24 Liquid flow channel
25 Upper wall
26 Wall
27 Lower wall
28 Drain
29 Lower wall
30 Porous member
31 Segment
32 Recess
33 Island
34 First port
35 Fitting
36 Drain channel
38 Catcher flow channels
39 Catcher plate
40 Second port
41 Transfer channel
42 Ramping duct wall transition
43 Heater
44 Second liquid flow channel
46 Third port
56 First portion
57 Second portion
59 Transition
58 Flow channel
60 Negative gas flow duct
62 Ink channel inlet
64 First port
65 Catcher face
66 Cleaning fluid
68 Flow of cleaning fluid
70 Edge
72 Ink reservoir
74 Ink pump
76 Filter
78 Cross flush valve
80 Vacuum pump
82 Catcher valve
84 Catcher waste valve
86 Valve
**86*b*** Valve
88 Return select valve
**88*b*** Return select valve
89 Flow restrictor
**89*b*** Flow restrictor
90 Liquid supply valve
**90*b*** Liquid supply valve
92 Cleaner liquid reservoir
94 Pump
96 Filter
98 Waste tank
100 Process for cleaning duct
110 Cleaning step
120 Cleaning step
130 Cleaning step
140 Cleaning step
150 Cleaning step
160 Cleaning step
170 Cleaning step
180 Cleaning step
200 Process for removing liquid from duct
210 Liquid removal step
220 Liquid removal step
230 Liquid removal step
240 Liquid removal step
250 Liquid removal step
260 Liquid removal step
270 Liquid removal step

The invention claimed is:

1. A continuous printhead drop deflector system comprising:

a gas flow duct including a wall, the wall including a liquid flow channel, the flow channel being in fluid communication with a first port; and a catcher including a channel, the channel being in fluid communication with a second port, wherein the catcher includes a wall that forms the wall of the gas flow duct.

2. The system of claim 1, the liquid flow channel being recessed within the wall of the gas flow duct, further comprising:

a porous member positioned to cover the liquid flow channel.

3. The system of claim 2, wherein the porous member is a screen made from one of a hydrophilic material and a material with a hydrophilic coating.

4. The system of claim 3, wherein a region of the gas flow duct adjacent to the porous member is made from one of a hydrophobic material and a material with a hydrophobic coating.

5. The system of claim 1, further comprising:

a vacuum source in fluid communication with the first port.

6. The system of claim 1, the gas flow duct having a width, wherein the flow channel substantially spans the width of the gas flow duct.

7. The system of claim 1, further comprising:

a vacuum source in fluid communication with the gas flow duct.

8. The system of claim 7, the liquid flow channel being a first liquid flow channel, further comprising:

a second liquid flow channel located between the first liquid flow channel and the vacuum source.

9. The system of claim 7, wherein the second portion of the wall of the gas flow duct is non-parallel relative to the first portion of the wall of the gas flow duct.

10. The system of claim 1, the wall of the gas flow duct including a transition from a first portion to a second portion, wherein the flow channel is located at the transition of the first portion and the second portion.

11. The system of claim 1, the liquid flow channel being in fluid communication with the first port through a drain, the liquid flow channel including a first segment having a cross sectional area and a second segment having a cross sectional area, wherein the cross sectional area of the first segment of the liquid flow channel is greater than the cross sectional area of the second segment of the liquid flow channel.

12. The system of claim 1, the liquid flow channel being in fluid communication with the first port through a drain, wherein the liquid flow channel is angled downward toward the drain.

13. A method of cleaning a printhead component comprising:

providing a gas flow duct including a wall, the wall including a liquid flow channel, the flow channel being in fluid communication with a first port;

providing a liquid;

causing the liquid to flow into the gas flow duct through the liquid flow channel using the first port; and removing at least some of the liquid from the gas flow duct through the liquid flow channel by applying a vacuum to the first port.

14. The method of claim 13 further comprising:

providing a catcher including a catcher face and a channel, the channel being in fluid communication with a second port;

causing a portion of the liquid to flow over the catcher face into the channel; and removing at least a portion of the liquid from the channel by applying a vacuum to the second port.

15. The method of claim 13, further comprising:

temporarily stopping the liquid flow when the fluid is in the gas flow duct prior to removing at least some of the liquid from the gas flow duct.

16. The method of claim 15, further comprising:

activating a gas flow source while the liquid flow is temporarily stopped in the gas flow duct to cause a gas flow to interact with the liquid in the gas flow duct.

17. The method of claim 16, wherein causing the gas flow to interact with the liquid in the gas flow duct comprises at least one of causing the gas flow to bubble the liquid, causing the gas flow to agitate the liquid, and causing the gas flow to move the liquid through the gas flow duct.

18. A method of removing liquid from a continuous printing system component comprising:

providing a gas flow duct including a wall, the wall including a liquid flow channel, the flow channel being in fluid communication with a first port;

providing a catcher including a channel, the channel being in fluid communication with a second port, the catcher including a wall that forms the wall of the gas flow duct;

providing a first vacuum source in fluid communication with the gas flow duct;

providing a second vacuum source in fluid communication with the first port;

causing any liquid present in the gas flow duct to move to the liquid flow channel by applying a vacuum to the gas flow duct using the first vacuum source; and removing the liquid from the liquid flow channel by applying a vacuum to the first port using the second vacuum source.

19. The method of claim 18, further comprising:

providing a porous member positioned to cover the liquid flow channel such that any liquid present in the gas flow duct enters the liquid flow channel through the porous member, wherein the vacuum applied to the first port using the second vacuum source is greater than the vacuum applied to the gas flow duct using the first vacuum source.

20. The method of claim 18, the wall of the gas flow duct including a transition from a first portion to a second portion, wherein the liquid flow channel is located at the transition of the first portion and the second portion.

* * * * *